US010974212B1

(12) United States Patent
Guoin et al.

(10) Patent No.: US 10,974,212 B1
(45) Date of Patent: Apr. 13, 2021

(54) VORTEXING CHAMBER AND SYSTEM

(71) Applicant: PERFECT WATER WORLDWIDE, LLC, Montecito, CA (US)

(72) Inventors: Kenneth J. Guoin, Santa Barbara, CA (US); Scott Anthony Pennington, Santa Barbara, CA (US)

(73) Assignee: PERFECT WATER WORLDWIDE, LLC, Montecito, CA (US)

( * ) Notice: Subject to any disclaimer, the term of this patent is extended or adjusted under 35 U.S.C. 154(b) by 241 days.

(21) Appl. No.: 16/152,365

(22) Filed: Oct. 4, 2018

Related U.S. Application Data

(60) Provisional application No. 62/569,432, filed on Oct. 6, 2017.

(51) Int. Cl.

| | |
|---|---|
| ***B01F 5/00*** | (2006.01) |
| ***B01F 3/04*** | (2006.01) |
| ***B01F 5/04*** | (2006.01) |
| ***B01F 5/06*** | (2006.01) |
| ***B01F 15/02*** | (2006.01) |

(52) U.S. Cl.
CPC ..... *B01F 5/0057* (2013.01); *B01F 3/0446* (2013.01); *B01F 5/0451* (2013.01); *B01F 5/0618* (2013.01); *B01F 5/0644* (2013.01); *B01F 5/0696* (2013.01); *B01F 15/0243* (2013.01); *B01F 2005/0017* (2013.01); *B01F 2005/0626* (2013.01); *B01F 2215/0037* (2013.01)

(58) Field of Classification Search
CPC .... B01F 3/0446; B01F 5/0057; B01F 5/0451; B01F 5/0618; B01F 5/0644; B01F 5/0696; B01F 15/0243; B01F 2005/0017; B01F 2005/0626; B01F 2215/0037
USPC ..... 261/37, 79.2, 108, DIG. 72, DIG. 75
See application file for complete search history.

(56) References Cited

U.S. PATENT DOCUMENTS 2,907,174 A 10/1959 Hendal
3,378,234 A * 4/1968 Svec ..... B01F 5/0609 366/338

(Continued)

FOREIGN PATENT DOCUMENTS

CN 203606310 U 5/2014

OTHER PUBLICATIONS

Barret, S., FTC Attacks 'Stabilized Oxygen Claims,' accessed at https://www.quackwatch.org/04ConsumerEducation/News/vitamino.html May 2000. 3 pages.

(Continued)

*Primary Examiner* — Charles S Bushey
(74) *Attorney, Agent, or Firm* — Steinfl + Bruno LLP

(57) ABSTRACT

A vortexing chamber, including: a chamber housing having a hollow channel, a first end and a second end; and one or more structural impediment objects having a substantially spherical, cubic, rectangular, cylindrical, polyhedron, tetrahedron, or irregular shape; where the objects are housed within the hollow channel, configured to mix a liquid and gas (for example, oxygen or nitrogen) when a liquid and gas pass through the vortexing chamber. The structural impediment objects can provide turbulence and dispersion when a liquid and gas are passed through the vortexing chamber at a high velocity, resulting in micro-bubbles or nano-bubbles suspended in a liquid and gas mixture.

6 Claims, 6 Drawing Sheets

(56) References Cited

U.S. PATENT DOCUMENTS

| | | | | |
|---|---|---|---|---|
| 3,682,446 | A * | 8/1972 | Eron | B01F 7/086 366/266 |
| 3,865,352 | A * | 2/1975 | Nelson | B01F 3/10 366/336 |
| 4,061,313 | A * | 12/1977 | Brauner | B01F 5/0619 366/340 |
| 4,136,976 | A * | 1/1979 | Leffelman | B01F 5/0682 210/335 |
| 4,204,775 | A * | 5/1980 | Speer | B01F 5/0647 366/336 |
| 4,230,571 | A | 10/1980 | Dadd | |
| 5,431,810 | A | 7/1995 | Russo et al. | |
| 5,858,430 | A | 1/1999 | Endico | |
| 5,888,403 | A * | 3/1999 | Hayashi | B01F 3/0446 210/695 |
| 5,938,328 | A * | 8/1999 | Pinto | B01F 5/0451 366/174.1 |
| 6,063,295 | A | 5/2000 | Williams et al. | |
| 6,272,934 | B1 * | 8/2001 | Rajan | B01F 5/0696 73/861.04 |
| 6,284,293 | B1 | 9/2001 | Crandall et al. | |
| 6,386,751 | B1 | 5/2002 | Wootan et al. | |
| 6,521,248 | B1 | 2/2003 | Holloway et al. | |
| 7,318,581 | B2 * | 1/2008 | Robards, Jr. | B01F 3/04787 261/59 |
| 7,806,584 | B2 | 10/2010 | Wootan et al. | |
| 8,550,696 | B2 | 10/2013 | Ebers et al. | |
| 8,771,524 | B2 | 7/2014 | Vorage et al. | |
| 10,626,036 | B1 | 4/2020 | Guoin | |
| 10,875,803 | B1 | 12/2020 | Guoin | |
| 10,897,920 | B1 | 1/2021 | Guoin | |
| 2003/0168754 | A1 * | 9/2003 | Spiegel | B01F 3/04787 261/94 |
| 2003/0230522 | A1 | 12/2003 | Pavel | |
| 2007/0286795 | A1 | 12/2007 | Chiba et al. | |
| 2008/0248164 | A1 * | 10/2008 | Spiegel | B01F 5/0696 426/67 |
| 2012/0085687 | A1 | 4/2012 | Simonette | |
| 2013/0041312 | A1 | 2/2013 | Eckert | |
| 2014/0166498 | A1 | 6/2014 | Orolin et al. | |
| 2017/0113954 | A1 * | 4/2017 | Stoppelbein | C02F 1/482 |
| 2017/0203986 | A1 | 7/2017 | Ervin | |

OTHER PUBLICATIONS

Battino, R. et al., "The Solubility of Oxygen and Ozone in Liquids", Journal of Physical and Chemical Reference Data, 12(2), pp. 163-178,(Jan. 1983).

Bickers, D.R., et al., "Oxidative Stress in the Pathogenesis of Skin Disease," Journal of Investigative Dermatology vol. 126(12):2465-75.Jan. 2006. 11 Pages.

Biocera Catalogue, published by Dr. Jeon Hyoung-Tag, Biocera Co., Ltd., South Korea, accessed on May 13, 2017 at http://www.biocera.co.kr, 30 pages.

Bunkin., N.F., et al., "Structure of the Nanobubble Clusters of Dissolved air in Liquid Media," J Biol Phys. vol. 38(1):121-52. Jan. 2012. 32 Pages.

Cameron., R., "Tiny Bubbles" *ACCJ Journal*, pp. 35-37.Jun. 2005. 3 Pages.

Chaplin., M., "Water Structure and Science: Nanobubbles (ultrafine bubbles)," accessed at http://www1.lsbu.ac.uk/water/nanobubble.html .Jan. 2007. 13 Pages.

Chougule , S.S., et al., "Comparative Study on Heat Transfer Enhancement of Low Volume Concentration of Al2O3—Water and Carbon Water Nanotube—Water Nanofluids in Laminar Regime Using Helical Screw Tape Inserts," *Exp. Heat Transfer*, vol. 28(1), pp. 17-36.Aug. 2015.21 Pages.

Connor, M.J., et al., "Depletion of Cutaneous Glutathione by Ultraviolet Radiation," *Photochemistry and Photobiology* vol. 46(2). pp. 239-245.Aug. 1987. 7 Pages.

Das, C. et al., "The Physics of Stratum Corneum Lipid Membranes", Philosophical Transactions A, The Royal Society Publishing, 374(2072), pp. 1-17,(Apr. 2016).

Duntas, L.H., et al., "Selenium and Inflammation—Potential Use and Future Perspectives" US Endocrinology, 11: 97-102.Jan. 2015. 6 Pages.

Ebina, K. et al., Oxygen and Air Nanobubble Water Solution Promote the Growth of Plants, Fishes, and Mice, PLOS One, vol. 8, Issue 6, (Jun. 2013), 7 pages.

Eucerin, "Understanding Skin", Accessed on Jun. 5, 2017 at http://www.eucerin.sg/about-skin/basic-skin-knowledge/skin-structure-and-function , 15 pages.

Harch, P.G., "Hyperbaric oxygen in chronic traumatic brain injury: oxygen, pressure, and gene therapy." Medical Gas Research vol. 5(9). Jul. 14, 2015. 4 pages.

"Hyperbaric Oxygen Therapy", Mayo Clinic, accessed on May 24, 2017 at http://www.mayoclinic.org/tests-procedures/hyperbaric-oxygen-therapy/basics/definition/prc-20019167 (Nov. 2014), 3 pages.

IDEC, "What are Ultrafine Bubble," Website accessed at https://www.idec.com/home/finebubble/bubble01.html Jan. 2017. 3 pages.

Ignatov, I. et al., "Structural Mathematical Models Describing Water Clusters", Published by The International Institute for Science, Technology and Education, vol. 3, No. 11, pp. 72-88,(Jan. 2013).

*Kaqun Hungary Oxygenated Water Research Studies*. "Report about Effects of Kaqun Water on the Speed of Cognitive Functions"; Kocsis, Z. et al., "Study on the Effect of Kaqun Water on Antioxidant Capacity"; Biro, A. et al., "The Effect of Kaqun—water on the Immune Parameters of Healthy Volunteers", National Institute of Chemical Safety, http://www.kaqun.sk/en/studies.Jan. 2012, 5 pages.

Kasai, Y. et al., "The H2O—O2 Water Vapour Complex in the Earth's Atmosphere", Atmospheric Chemistry and Physics, 11(16), pp. 8607-8612,(Aug. 2011).

Kim, A.L. et al., "Role of p38 MAPK in UVB-Induced Inflammatory Responses in the Skin of SKH-1 Hairless Mice," Journal of Investigative Dermatology vol. 124(6):1318-25.Jun. 2005. 8 Pages.

Ladizinsky, D. et al., "New Insights Into Oxygen Therapy for Wounded Healing", Wounds, 22(12), pp. 294-300,(Jan. 2010).

Lambrechts et al., "Normalizing Tumor Oxygen Supply Could Be Key Factor in the Fight against Cancer", Nature,(Aug. 2016), 1 page.

Lee, Y.S., et al., "Long Course Hyperbaric Oxygen Stimulates Neurogenesis and Attenuates Inflammation after Ischemic Stroke," Mediators of Inflammation vol. 2013, Article ID 512978, 13 pages. Jan. 2013. 14 Pages.

Li, H., et al., "Antagonistic Effects of P53 and HIF1A on MicroRNA-34—a Regulation of PPP1R11 and STAT3 and Hypoxia-induced Epithelial to Mesenchymal Transition in Colorectal Cancer Cells," American Gastroenterological Association vol. 153(2): 505-20. Aug. 2017. 17 pages.

Lower, S., "H2O: A Gentle Introduction to Water and its Structure," accessed at http://www.chem1.com/acad/sci/aboutwater.html on Sep. 5, 2019. 15 Pages.

Ludwig-Maximilians-Universität München. "Cancer Metastasis: The unexpected perils of hypoxia." ScienceDaily, May 11, 2017, Accessed at https://www.sciencedaily.com/releases/2017/05/170511113523.htm . 5 Pages.

Madagascar Minerals "Rose Quartz Spheres" website, accessed Oct. 16, 2017. Tucson, AZ. Jan. 2003, www.madagascarminerals.com/cat_rose_quartz_spheres1.cfm.

Mayo Clinic. "Skin cancer on the rise." ScienceDaily, May 15, 2017. Accessed at http://www.sciencedaily.com/releases/2017/05/170515141000.htm. 5 Pages.

McColl, A., et al., "TLR7-mediated skin inflammation remotely triggers chemokine expression and leukocyte accumulation in the brain," Journal of Neuroinflammation vol. 13 (102).May 2016. 16 Pages.

McCombs, Dr. Jeffrey, "The Physiology of Oxygenated Water", 4 pages,(May 2017).

"Naneau: Breathing Life into Water," 2019 Website. Accessed at http://www.inspiredwaters.com/ on Sep. 2019. 11 Pages.

"Naneau O2 Water," Jan. 2019 Marketing materials by Naneau. 26 Pages.

(56) References Cited

OTHER PUBLICATIONS

Naneau Oxygen Nanobubbles Website: Home page, About Naneau, and the Science behind Naneau. Accessed fromhttps://naneauhealth.com/ on Nov. 21, 2019. 26 Pages.
Non-Final Office Action for U.S. Appl. No. 15/727,560, filed Oct. 6, 2017 on behalf of Perfect Water Worldwide, LLC, dated Aug. 21, 2019. 21 Pages.
Pansky, B., "Review of Medical Embryology Book, Chapter 25: Germ Layers and their Derivatives," accessed at https://discovery.lifemapsc.com/library/review-of-medical-embryology/chapter-25-germ-layers-and-their-derivativeson Sep. 5, 2019. 2 Pages.
Potts, R.O. et al., "Lipid Biophysics of Water Loss through the Skin", Proceedings of the National Academy of Sciences,87(10), pp. 3871-3873,(May 1990).
Reelfs, O., et al., "Ultraviolet A Radiation-Induced Immediate Iron Release Is a Key Modulator of the Activation of NF-κB in Human Skin Fibroblasts," Journal of Investigative Dermatology vol. 122(6):1440-47. Jun. 2004. 8 Pages.
Restriction Requirement for U.S. Appl. No. 15/727,470, filed Oct. 6, 2017 on behalf of Perfect Water Worldwide, LLC, dated Oct. 28, 2019. 6 pages.
Restriction Requirement for U.S. Appl. No. 15/727,560, filed Oct. 6, 2017, on behalf of Perfect Water Worldwide LLC, dated Jan. 2, 2019. 9 pages.
Scheuplein, R.J., "Mechanism of Percutaneous Absorption: II. Transient Diffusion and the Relative Importance of Various Routes of Skin Penetration," Journal of Investigative Dermatology vol. 48(1): 79-88.Jan. 1967. 10 pages.
Shimadzu, Application News, Nano Particle Size Analyzer: SALD-7101, No. 4, Downloaded from http://www.ssi.shimadzu.com/products/literature/testing/microbubbles%20nanobubbles%20red.pfd accessed on Jul. 24, 2017. pp. 1-3.
Spivey, N., "Application Note, Atomic Absorption, Analysis of Major Elements in Drinking Water Using FAST Flame Sample Automation for Increased Sample Throughput", pp. 1-5,(Jan. 2015).
"State of the Air 2016," Report by the American Lung Association, accessed at http://www.lung.org/assets/documents/healthy-air/state-of-the-air/sota-2016-full.pdf in Jan. 2016. 157 Pages.
Stücker, M., et al., "The Cutaneous Uptake of Atmospheric Oxygen Contributes Significantly to the Oxygen Supply of Human Dermis and Epidermis", The Journal of Physiology, 538(3), pp. 985-994, (Jan. 2002).
Stillinger, F.H., "Theory and Molecular Models for Water", Adv. Chem. Phys.,31(1), 101 pages,(Jan. 1975).
"Thermo Scientific Orion Chlorine XP Water Quality Analyzer", UM-269688-001 Revision C, pp. 1-57,(Nov. 2016).
Uchida, T. et al., "Effect of NaCL on the Lifetime of Micro- and Nanobubbles", Nanomaterials, 6(2), 10 pages,(Feb. 2016).
United States Environmental Protection Agency, Method 8265, Volatile Organic Compounds in Water, Soil, Soil Gas, and Air by Direct Sampling Ion Trap Mass Spectrometry (DSITMS),pp. 1-64,(Mar. 2002).
Van Smeden, J. et al., "Stratum Corneum Lipids: Their Role for the Skin Barrier Function in Healthy Subjects and Atopic Dermatitis Patients", Curr. Probl. Dermatol. 49; pp. 8-26, 2 pages (abstract only),(Feb. 2016).
Warburg Heinrich, Dr. Otto, "The Root Cause of Cancer", 1 page (Jan. 1931).
Wikipedia, "Air pollution", accessed on May 26, 2017 at https://en.wikipedia.org/wiki/Air_pollution .,pp. 1-26.,(May 2017).
Wikipedia, Metastability, accessed on Jun. 5, 2017 at https://en.wikipedia.org/wiki/Metastability .,pp. 1-5, (May 2017).
Xi., C., et al., "Reduction of Ammonia Emission in Chicken Farms by Improved Water Systems," Jan. 2011. Accessed from http://www.inspiredwaters.com/naneau-science-studies/ on Sep. 2019. 2 Pages.
Reading, SA., et al., "Oxygen Absorption by Skin Exposed to Oxygen Supersaturated Water", Can J Physiol. Pharmacol.,(May 2012),1 page (abstract only).
Reading, SA., et al., "Skin Oxygen Tension is Improved by Immersion in Oxygen-Enriched Water", Int. J. Cosmet. Sci.(Dec. 2013),1 page (abstract only).
Yin, H., et al., "Metastable Water Clusters in the Nonpolar Cavities of the Thermostable Protein Tetrabrachion", Journal of the American Chemical Society,129(23), pp. 7369-7377,(Jan. 2007).
Yurchenko., S.O., et al., "Ion-Specific and Thermal Effects in the Stabilization of the Gas Nanobubble Phase in Bulk Aqueous Electrolyte Solutions," Langmuir 32 (43):11245-11255.Jun. 2016. 12 Pages.
Zhang, Q., et al., "Hyperbaric Oxygen Attenuates Apoptosis and Decreases Inflammation in an Ischemic Wound Model," J Invest Dermatol, 128(8):2102-12.Mar. 2008. 11 Pages.
Zhao, B., et al., "Hyperbaric oxygen attenuates neuropathic pain and reverses inflammatory signaling likely via the Kindlin-1/Wnt-10a signaling pathway in the chronic pain injury model in rats," J Headache Pain, 18(1).Jan. 5, 2017. 8 Pages.
Briganti, S., et al., "Antioxidant Activity, Lipid Peroxidation and Skin Diseases. What's New," The Journal of the European Academy of Dermatology and Venereology, 17 (6).Oct. 2003. 1 Page. Abstract Only.
Dhar, A., et al., "The role of AP-1, NF-κB and ROS/NOS in skin carcinogenesis: The JB6 model is predictive," Mol and Cellular Biochem vol. 234(1):185-93. May 2002. 1 Page. Abstract Only.
Ernstene, C., et al., "Cutaneous Respiration in Man," J Clin Invest. May 1, 1932;11(2):387-390. 5 Pages.
Fitzgerald, L.R., et al., "Cutaneous respiration in man," Physiological Reviews vol. 37(3):325-345. Jul. 1, 1957. 3 Pages. First Page Only.
Gruber, R.P., et al., "Skin Permeability to Oxygen and Hyperbaric Oxygen," Arch Surg. 101(1):69-70. Jul. 1970. 1 Page. Abstract Only.
Kaqun: The Element Kaqun Studies 2004-2013, 2nd Edition. Budapest, 2013. 183 Pages.
Kotecha, R., et al, "Oxygen treatment attenuates systemic inflammation via cholinergic pathways," Journal of surgical Research vol. 181(1):71-73. Mar. 28, 2012. 1 Page. Abstract Only.
Non-Final Office Action for U.S. Appl. No. 15/727,470, filed Oct. 6, 2017 on behalf of Perfect Water Worldwide, LLC, dated Jan. 22, 2020. 15 pages.
Notice of Allowance for U.S. Appl. No. 15/727,560, filed Oct. 6, 2017 on behalf of Perfect Water Worldwide, LLC, dated Feb. 13, 2020. 13 pages.
Scheuplein, R.J., et al., "Permeability of the Skin," Psychological Reviews vol. 51(4): 702-47. Oct. 1971. 1Page. Introduction Only.
Notice of Allowance for U.S. Appl. No. 15/727,217, filed Oct. 6, 2017 on behalf of Perfect Water Worldwide dated Oct. 20, 2020 11 pages.
Corrected Notice of Allowability for U.S. Appl. No. 15/727,470, filed Oct. 6, 2017 on behalf of Perfect Water Worldwide, LLC, dated Aug. 5, 2020. 3 pages.
Non-Final Office Action for U.S. Appl. No. 15/727,217, filed Oct. 6, 2017 on behalf of Perfect Water Worldwide, LLC, dated Jun. 17, 2020. 17 pages.
Notice of Allowance for U.S. Appl. No. 15/727,470, filed Oct. 6, 2017 on behalf of Perfect Water Worldwide, LLC, dated Jun. 26, 2020. 15 pages.

* cited by examiner

VORTEXING CHAMBER AND SYSTEM

CROSS REFERENCE TO RELATED APPLICATIONS

The present application claims priority to U.S. Provisional Patent Application No. 62/569,432, filed on Oct. 6, 2017. The present application is related to U.S. application Ser. No. 15/727,217 entitled "SELF-CONTAINED WATER SYSTEM" filed on Oct. 6, 2017, now U.S. Pat. No. 10,897,920; U.S. application Ser. No. 15/727,560 entitled "HYPER-OXYGENATED WATER COMPOSITIONS AND RELATED METHODS AND SYSTEMS" filed on Oct. 6, 2017, now U.S. Pat. No. 10,626,036; and U.S. application Ser. No. 15/727,470 entitled "HYPER-OXYGENATED SOAKING SPA SYSTEM" filed on Oct. 6, 2017, now U.S. Pat. No. 10,875,803, each of which is incorporated herein by reference in its entirety.

TECHNICAL FIELD

The present disclosure relates to a system for mixing quantities of gas into quantities of liquid. Particularly, a system mixes a gas and a liquid by passing the liquid and gas through one or more vortexing chambers. A vortexing chamber, according to the present disclosure, can have a channel, the channel houses one or more structural impediment objects, configured to create turbulence, voids, pressure variations and dispersion in a passing fluid of liquid and gas. The system mixes the liquid and gas by passing the fluids through the vortexing chamber, resulting in a saturated or hyper-saturated liquid and gas mixture. In the resulting mixture, the gas can take the form of micro-bubbles and/or nano-bubbles, suspended in the liquid.

BACKGROUND OF THE INVENTION

Liquid and gas mixing vortexer devices are known and used for a variety of applications, and take different forms. For example, laboratory mixers and vortexers generally include a base with controller that is capable of holding and moving (for example, by shaking, swirling, and/or vibrating) vessels (for example, test tubes, beakers, and vials), to mix a liquid and gas within the vessels. Laboratory mixers and vortexers, however, are not suitable for providing a continuous flow of large quantities of a mixed liquid and gas, because the steps of adding a liquid and gas to be mixed in a vessel, mixing the liquid and gas in the vessel, and removing the mixed liquid and gas from the vessel is time consuming and results in a relatively small volume of a mixed fluid.

A liquid and gas vortexing system more suitable for continuously mixing higher volumes of liquid and gas can have a channel providing for the flow of liquid, a gas supply, and a vortexing chamber. Such system may include active moving components, for example, a rotating impeller or a beater, to sheer gas bubbles, mix the gas through the liquid and to create turbulence in the liquid and gas.

Devices for mixing a liquid and gas have various benefits. For example, providing drinking or bathing water with hyper-saturated oxygen micro-bubbles or nano-bubbles suspended in water may provide health benefits. Similarly, suspending nitrogen in water or another suitable liquid can be used for soft drinks. In addition, liquid and gas mixtures are frequently required in laboratory environments for research and testing in the chemical arts.

BRIEF SUMMARY OF THE INVENTION

The present disclosure provides an improved vortexing chamber, having impediment objects, baffles or combinations thereof, without active moving parts (for example, a rotator, a motor driven device, actuators, or any other movement that is not driven from the liquid and gas passing through the chamber).

The present disclosure also provides for an improved mixing of liquid (for example, water) and gas (for example, oxygen or nitrogen), having greater turbulence and greater variations in pressure when a high velocity liquid and gas are passed through it, thus creating an improved dispersion of micro-bubbles and/or nano-bubbles, and a higher concentration of stabilized micro-bubbles and nano-bubbles over the present state of the art.

The present disclosure also provides a vortexing device that simulates natural oxygen-water mixing elements found in nature, for example, water trickling over rocks down a stream.

The present disclosure also utilizes natural radiation of crystal structures to impart a structure upon the mixture, within the vortexing chamber. Water, for example, can be restructured through radiation, or radiant energy. The natural and subtle radiation of gems or crystals may, therefore, modify the structure of drinking water.

The present disclosure relates to a system for mixing a gas and a liquid. Particularly, the system mixes a gas and a liquid by passing the liquid and gas through a vortexing chamber. The vortexing chamber can have a channel, where the channel houses structures that are configured to create turbulence, voids, and pressure variations within the chamber when the liquid and gas are passed through at a high velocity. The turbulence, voids, and pressure variations within the chamber can create micro-bubbles and/or nano-bubbles of the gas within the liquid, and disperse the bubbles in the liquid, resulting in a saturated or hyper-saturated liquid and gas mixture, the gas taking the form of micro-bubbles or nano-bubbles, suspended in the liquid.

According to a first aspect of the invention, a vortexing chamber includes: a chamber having a hollow channel, a first end and a second end; and one or more structural impediment objects, the objects having substantially spherical (for example, spherical rose quartz crystals with one inch diameter), cubic, rectangular, cylindrical, polyhedron, tetrahedron, or irregular shape (for example, one inch pebbles), wherein the objects are housed within the hollow channel, configured to mix a liquid and gas when a liquid and gas are passed through the mixing chamber, resulting in gas micro-bubbles and/or nano-bubbles suspended in the liquid.

According to a second aspect of the invention, a vortexing system includes: a high velocity liquid pump; a gas supply; a vortexing chamber (for example, the chamber described in the preceding paragraph); and one or more devices fluidly connecting an output of the high velocity liquid pump to a gas supply and a vortexing chamber. For example, a first end of an intermediate channel can connect to an outlet of the high velocity liquid pump, a second end of the intermediate channel can connect to a first end of the vortexing chamber, and the gas supply can be configured to introduce a gas into a liquid within the intermediate channel through an injection Tee pipe that is positioned between the first end and second end of the intermediate channel.

Furthermore, an inlet of the high velocity pump can connect to a liquid supply, and the high velocity liquid pump can circulate a liquid through the vortexing chamber while a gas is introduced into the liquid through the gas supply, resulting in a hyper-saturated liquid and gas mixture.

Further aspects of the disclosure are described and shown in the detailed description, drawings and claims of the present application.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION OF THE INVENTION

A "rose sphere" or "rose quartz sphere" or "quartz sphere" or "sphere quartz" as used herein describes a rose quartz crystal having substantially a spherical shape.

A "mixture", as used herein describes a composition of a liquid and a gas in a stable manner, including gas dissolved in a liquid, gas clusters in a liquid, and gas suspended or entrained in a liquid.

A "channel" as used herein describes a conduit having at least a first end and a second end, for example, a straight pipe, capable of facilitating the flow of a liquid and/or gas.

A "impediment object" as used herein describes generally a physical object or objects within the channel of the vortexing chamber according to the present invention.

A "solution" as used herein describes a mixture composed of two or more substances, where a solute is dissolved in a solvent.

A "gas" as used herein describes a state of matter, neither liquid or solid, in which the gaseous substance is a compressible fluid, and will conform to a shape of its container but will also expand to fill the container.

A "liquid" as used herein describes a phase of matter, neither gaseous or solid, in which a substance can freely flow but have a stable volume, for example, water, gasoline, or a solution.

"Hyper-saturated" as used herein describes the dispersion of a gas in a liquid such that the gas concentration in the liquid is higher than that found in normal conditions.

"Hyper-oxygenated" as used herein describes a hyper-saturated dispersion where the gas is oxygen, dispersed in the liquid at a point of equilibrium higher than that found in normal conditions. For example, the chambers described herein are capable of mixing water and molecular oxygen ($O_2$) such that the resulting mixture contains a molecular oxygen concentration of 10 ppm or greater dispersed in the water at 4° C. to 50° C.

A "baffle" or "baffles" as used herein describes one or more vanes, panels, discs, or plates, configured in a manner to obstruct but not completely block the flow of a passing fluid. The one or more vanes, panels, discs or plates can be interconnected or networked.

A "fluid" as used herein describes a gas, a liquid, or mixtures thereof.

A "passive" mixing structure, as used herein in the context of the vortexing chamber, describes a mixing structure that does not require an external source of movement, for example a motor or actuator, to rotate, vibrate, or otherwise move parts to mix the contents of the vortexing chamber. "Passive" can therefore include movements, for example, vibration, spinning, and general displacement, of the mixing structure, caused by the flow of the liquid and gas through the chamber.

Figure 1B:
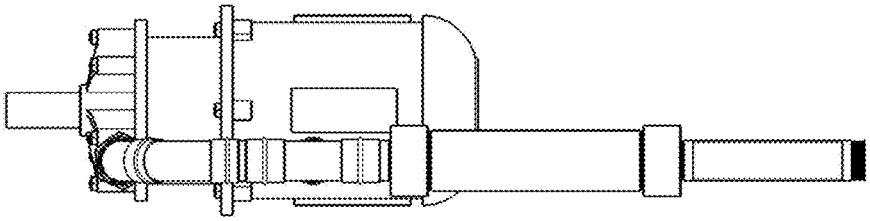
FIGS. 1A (side view), 1B (top view), and 1C (gas supply) show an embodiment of a vortexing system according to the present invention.

Referring now to FIG. 1, a vortexing system of the present invention may include: a high velocity liquid pump 200; a gas supply 310 (for example, oxygen or nitrogen); a vortexing chamber 100; and one or more devices to fluidly connect an output of the high velocity pump 200 to the gas supply 310 and the vortexing chamber 100, where the gas from the gas supply 310 is between the high velocity pump 200 and the vortexing chamber 100.

For example, a first end 301 of an intermediate channel 300 can interface to an outlet 201 of the high velocity liquid pump 200, the gas supply 310 can be configured to introduce a gas to a liquid within the intermediate channel through a Tee connection 311, a second end 302 of the intermediate channel 300 connects to a first end 101 of the vortexing chamber 100, an inlet 202 of the high velocity pump 200 connects to a liquid supply, and the high velocity liquid pump circulates the liquid and gas through the vortexing chamber 100 at a high velocity, resulting in a hyper-saturated liquid and gas mixture at the output 102 of the vortexing chamber 100.

The high velocity pump 200 can pump a flow rate of more than twenty-five gallons per minute (GPM). For example, the high velocity pump 200 can be a Serfilco pump, series ME8, capable of forty-five GPM. Furthermore, the velocity of the liquid at the point of the introduction of gas (for example, oxygen or nitrogen) into the liquid by the gas supply 310 may be a function of the overall fluid rate of the system and the cross-sectional area of the fluid channels, where the speed of the liquid at the point of introduction increases as the flow rate increases and the cross-sectional area of the intermediate channel decreases. A high velocity of the liquid at a point of introduction of the gas into the liquid by gas supply 310 is critical to gas dispersion and creation of micro-bubbles and/or nano-bubbles in the hyper-saturated mixture.

Figure 1A:
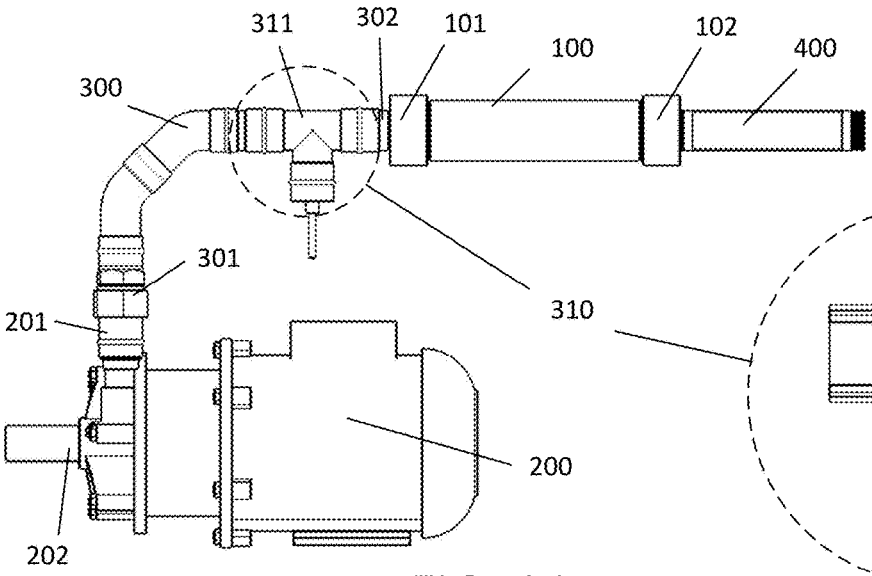
Figure 1C:
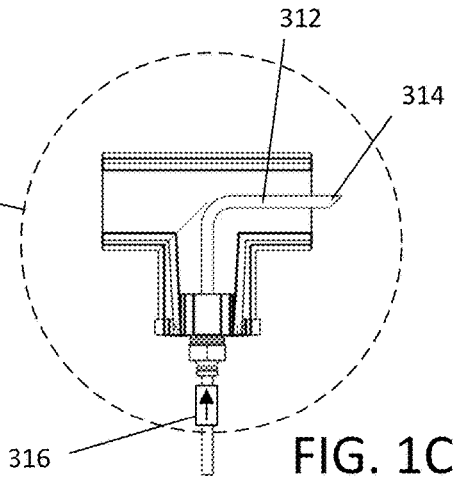

As shown in FIGS. 1A and 1C, the gas supply 310 can include a gas tube or pipe 312 made of a metal, for example, stainless steel or copper, or a polymer based material, for example PVC. The gas supply 310 may enter the intermediate channel 300 in a direction perpendicular to the flow of the liquid, for example, through a Tee fitting 311. The gas supply tube 312 may be configured with a bend at an angle such that the gas generally enters against the flow of the liquid, or it may bend at an angle such that the gas generally flows in the same direction of the liquid flow, as shown in FIG. 1C. The gas supply may have an open-ended edge 314. The open-end edge 314 can be diagonal with respect to the orientation of the pipe 312, for example between 30° to 60°, therefore increasing the surface area of the opening. Alternatively, the opening may be substantially perpendicular orientation of the gas tube, therefore minimizing the surface area of the gas supply opening. The gas supply can include a check valve 316, to advantageously ensure the fluid flow in the direction from the gas supply to the liquid.

The opposite end of the gas tube 312 can be connected to a gas provider (not shown), capable of providing a gas. The gas provider can, for example, be an oxygen ($O_2$) supply. Similarly, the gas provider can be a nitrogen ($N_2$) supply. The gas provider can provide a gas at a desired pressure, for example, at twenty PSI. For example, the gas provider can be a concentrator or a compressor (for example, a scroll compressor) connected to an oxygen membrane.

Advantageously, when the liquid flowing through the pump is water, the gas provider can be oxygen ($O_2$) to provide drinking or bathing water. The gas can also be nitrogen ($N_2$) when the resulting fluid is purposed for soft drinks.

The system can further comprise a transparent (inspection) channel 400, configured to facilitate visual monitoring by being substantially transparent. The transparent channel can have a chamber body, where the entire chamber body of the transparent channel is transparent, providing a complete visual understanding of the liquid and gas mixture. Alternatively, the transparent channel may be substantially opaque and provide a window of transparency for visual inspection. It is advantageous to locate the transparent channel at the second end (output end) 102 of the vortex chamber 100, to allow for inspection of the liquid and gas mixture after passing through the vortex chamber.

Various plumbing elements can be used in the system to connect the various aforementioned parts, for example, the intermediate channel 300, the gas supply 310, and the vortexing chamber 100 can comprise fluid carrying plumbing parts, for example, pipes, unions, gaskets, tees, and fittings, made of suitable materials, for example, copper, stainless steel, rubber and/or PVC.

Figure 2B:
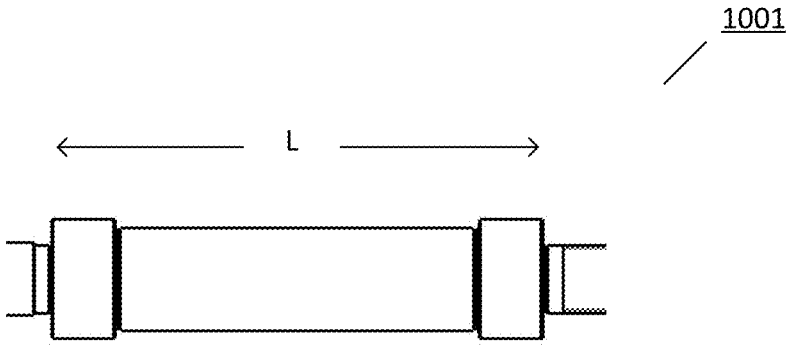
FIGS. 2A (exploded view), and 2B (combined view) show an embodiment of a vortexing chamber having a plurality of structural impediment objects.
Figure 2A:
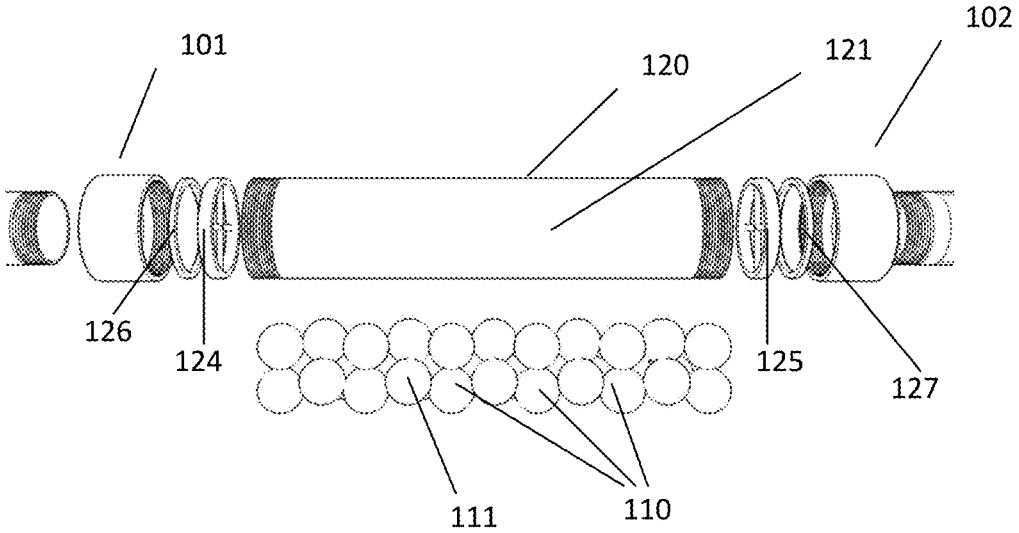

Referring now to FIGS. 2A and 2B, an embodiment of the vortexing chamber 1001 of the present invention can include: a chamber housing 120 having a hollow channel 121, a first end 101 and a second end 102; one or more structural impediment objects 110, the objects 110 having a substantially spherical, cubic, rectangular, cylindrical, polyhedron, tetrahedron, or irregular shape; wherein the a plurality of impediment objects 110 are housed within the hollow channel 121, configured to mix a liquid and gas when a liquid and gas are passed through the vortexing chamber, resulting in a mixture having gas bubbles being suspended in the liquid.

In a particular embodiment, the impediment objects 110 can comprise of rose quartz spheres having diameters, for example, between ten mm and twenty-five mm, or more preferably between fifteen mm and nineteen mm. Preferably the rose quartz spheres are energized crystals. Rose quartz crystals can be obtained from Madagascar Minerals, at http://www.madagascarminerals.com/cat_rose_quartz_spheres.cfm.

A vortexing chamber 1001 having rose quartz spheres, used to mix water and oxygen was found to provide a surprising and unexpected result for bathing water. Bathers described an improvement in the texture of the water and improved health and medicinal benefits from bathing in the water.

The vortexing chamber 1001 may be filled by the structural impediment objects 110 until maximum capacity. In other words, the chamber may be filled with structural impediment objects 110 until no more structural impediment objects 110 can fit in the chamber. In another embodiment, the chamber can be partially filled to a desirable level of capacity, based on a desired amount of movement or play between the structural impediment objects 110. Thus, through routine experimentation, capable by one skilled in the art, a desired level of movement, play, and capacity can be achieved.

The one or more impediment objects 110 can have a smooth or have a rough surface texture, and they can be solid or hollow. The objects having smooth surfaces may be advantageous for faster flow of liquid and gas due to reduced surface friction and drag. A rough surface texture can create more turbulence, however, a carefully chosen roughness may suppress turbulence, resulting in lower drag. The surface texture, therefore, can be selectable based on routine experimentation, capable by one skilled in the art, to arrive at a desired texture.

Although the chamber housing 120 shown in FIGS. 2A and 2B has a substantially circular cross-section, it is contemplated that the chamber housing 120 can have a different cross-sectional shape, for example, a square, rectangle, or oval.

The one or more impediment objects can have passive movement, i.e., without rotating or connection to a motor, based on the turbulence and kinetic energy generated by passing the high velocity liquid and gas through the vortexing chamber.

For example, the liquid and gas passing through the vortexing chamber at a high velocity will generate kinetic energy, whereby the kinetic energy will promote the impediment objects to shake, vibrate, spin, and collide, therefore creating passive movement that further generates gas micro-bubbles and/or nano-bubbles and disperses such bubbles within the liquid. The vibrational movement, in particular, of the impediment objects can create collisions between the objects and bubbles within the fluid, therefore resulting in smaller bubbles. Furthermore, the vibrational frequency results in greater variations in pressure and results in nano-voids in the fluid.

Furthermore, in the case where impediment objects include rose quartz crystals, or other crystals, the kinetic movement or vibration of the crystals can further enhance the natural vibrational energy of the crystals, which can then impart an additional harmonic vibration upon the passing fluid.

For example, the impediment objects can spherical rose quartz 111, where, during operation, when water and oxygen are passing through the chamber at a high velocity, the crystals vibrate at frequencies and impart a signature structure upon the resulting hyper oxygenated water.

Furthermore, the impediment objects can simulate natural water structuring systems. For example, a plurality of spherical impediment objects housed in the vortexing chamber can simulate natural impediment objects, such that when water and oxygen pass through the vortexing chamber, the chamber mixes the water and oxygen similar to water passing over and around pebbles and rocks in a stream or river.

The chamber housing 120 can be a hollow pipe, having an interior surface and an exterior surface, the interior surface being in direct contact with the liquid and gas fluid, where the hollow channel 121 is the interior space of the pipe. The chamber housing 120 can be substantially straight, or be bent at angles. A substantially straight housing can be advantageous, however, by providing for higher fluid flow rates. Furthermore, the chamber housing 120 can be substantially transparent, which can provide for visual inspection.

The vortexing chamber can include one or more devices to retain the impediment objects so that they are not inadvertently forced from the chamber due to pressure from the passing high velocity fluid. For example, the vortexing chamber can comprise retaining rings 124 and 125 and gaskets 126 and 127 at the first end 101 and the second end 102 of the vortexing chamber, the retaining rings configured to prevent the one or more impediment objects from inadvertently exiting the chamber housing. The retaining rings can, for example, have a mesh, net or fence with openings smaller than the one or more impediment objects 110.

With reference to the 'combined view' of FIG. 2B, the chamber housing 120 may run substantially the entire length L of the vortexing chamber 1001. The length L of the vortexing chamber may be, for example, between five inches and sixty inches (thirteen cm-one-hundred fifty cm). The vortexing chamber can have any suitable diameter, for example, between three-eighths of an inch to approximately six inches (ten mm-fifteen cm). Also, the vortexing chamber can have a length L between twenty inches and thirty inches (fifty cm-seventy-five cm) with a diameter of approximately two inches (five cm).

Advantageously, the one or more impediment objects may be a plurality of impediment objects, housed in the hollow channel, and generally free of attachments, fasteners, anchors, and other movement burdening implementations. In this manner, the objects can provide passive movement generated by the kinetic energy of the fluid flow and surface friction, resulting in improved turbulence, collisions, vibrations, and variations in fluid pressure.

Figure 3B:
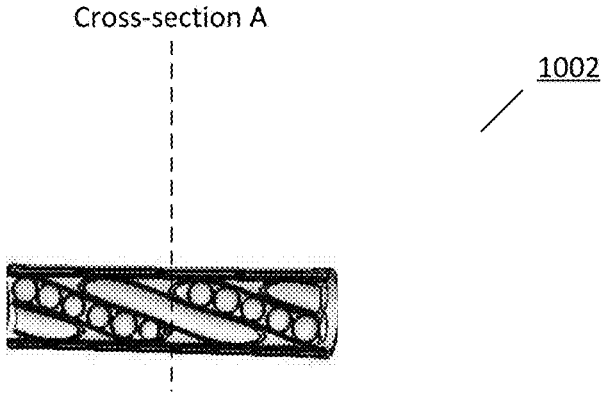
FIGS. 3A (exploded view), 3B (combined view), and 3C (cross-sectional view) show an embodiment of a vortexing chamber, having a plurality of structural impediment objects and internal channels.
Figure 3A:
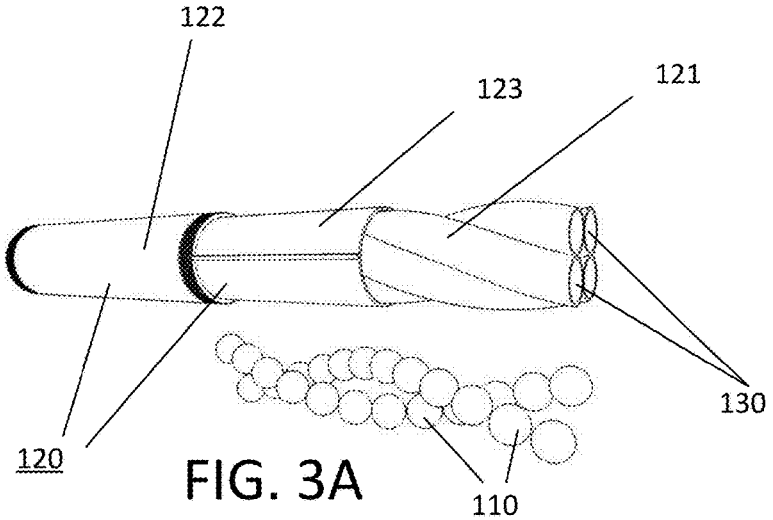
Figure 3C:
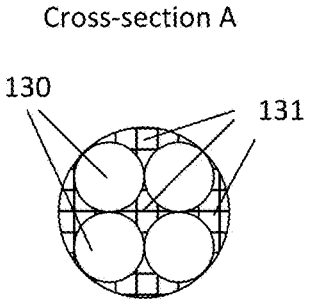

Referring now to FIGS. 3A, 3B, and 3C, an embodiment of a vortexing chamber 1002 can include a chamber housing 120 having one or more internal channels 130 housed within the hollow channel 121 of the chamber housing 120. FIG. 3C shows the internal channels 130 provide a first mixing path for the liquid and gas within the internal channels, and a negative (open) space 131 between the internal channels 130 and the internal surface of the chamber housing 120 provides a second mixing path, the structural impediment objects 110 are housed within the one or more internal channels 130 and not in the negative (open) space 131. The chamber housing 120 and/or the one or more internal channels 130 can be substantially circular in cross section, and the one or more internal channels can be twisted in a spiral within the hollow channel 121.

As shown in FIG. 3A, the chamber housing 120 may comprise an outer sleeve 122 and an inner sleeve 123, where the inner sleeve is housed in the outer sleeve, and the internal channels 130 are gripped and anchored by the inner sleeve.

The one or more internal channels 130 may have a slightly larger inner diameter of the impediment objects, advantageously maintaining a high velocity flow rate, while still providing the turbulence creating properties of the impediment objects. For example, each of the one or more internal channels may have an internal diameter of approximately one and one-eighth inch (three cm) while the diameter of the impediment objects may be about one inch (two to three cm).

Furthermore, it is advantageous to have a plurality of internal channels 130, for example three or four internal channels, therefore providing an optimal balance of flow between both the first mixing path and the second mixing path, resulting in improved dispersion and suspension of micro-bubbles and/or nano-bubbles in the resulting mixture.

Furthermore, it is advantageous to that one or two of the internal channels are populated with the impediment objects, and one or two of the internal channels are not populated (not having impediment objects), to provide three mixing path configurations: a mixing path in the negative space 131, another mixing path in the internal channel or channels having impediment objects, and another mixing path in the internal channel or channels having no impediment objects.

Alternatively, the negative space 131 may be blocked or potted, thereby forcing the liquid and gas through the internal channels 130.

Figure 4:
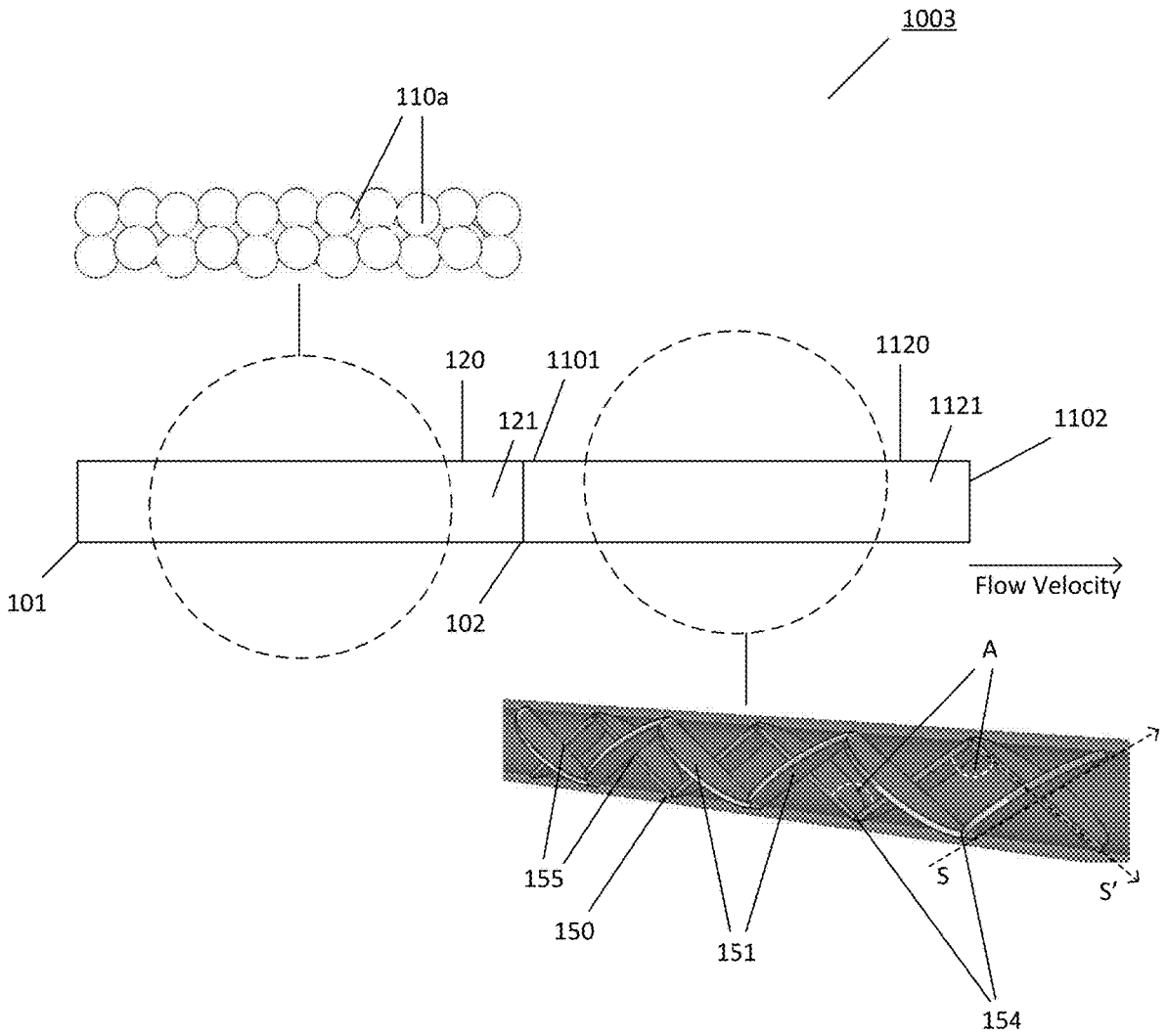
FIG. 4 (exploded view) shows an embodiment of a vortexing chamber having a first channel housing structural impediment objects, and a second channel housing baffles.

Referring now to FIG. 4, an embodiment of the vortexing chamber 1003 can also include a second chamber housing 1120, the second chamber housing having: a second hollow channel 1121; a first end 1101; a second end 1102; and one or more baffles 150 housed in the second hollow channel 1121 of the second chamber housing 1120.

The first end 1101 of the second chamber housing 1120 can be connected in series with the second end 102 of the first chamber housing 120, and the baffles 150 can include a plurality of interconnected plates 151 where each plate 151 is joined to an adjacent plate 151 forming an angle A. For example, each plate 151 can have a sequential connection 154 to an adjacent plate 151, creating a chain of plates joined at angles A and running lengthwise L along the chamber. Additionally, the plates 151 can have intersecting connections 155 (connecting to an adjacent plate, in a direction perpendicular to the length L), connecting two or more chains of plates in parallel, such that the parallel chains run length-wise through the second chamber housing, where the slope S of a plate alternates with respect to a slope S' of an adjacent parallel plate. The angles A can be between zero and one hundred-eighty degrees.

Each plate 151 can be substantially flat, and substantially have the shape of a semi-circle or a half-circle or a half-disc. In this manner, the baffle 150 can consist of two chains of plates 151 running side-by-side in parallel, substantially along the length L, where the two chains are connected to each other by parallel connections 155. In such a manner, the two chains create alternative flows for the fluid, whereby the angles of the plates and the speed of the fluid generates large variations of pressure within the fluid. Similarly, the interior edges of the baffles can have a shearing effect on the fluid, causing shearing to the gas bubbles, and resulting in improved dispersion and smaller gas bubbles.

Such a configuration of baffles 150 is not a spiral configuration of panels or plates. Rather, the baffles provide alternating paths, and flows, where the resulting fluid may spin, but the structure of the baffles is not a single spiraling panel.

The baffles 150 may be fixed in the chamber housing 120, for example, the baffles may be glued or melted into place to the inner surface of the chamber housing 120.

The plates 151 of the baffles 150 may be configured at the first end 1101 of the second chamber housing 1120 such that they act as a retaining wall for the impediment objects 110 housed in the first chamber housing 120, therefore obviating a need for a retaining ring 124, as depicted in FIG. 2A.

Figure 5A:
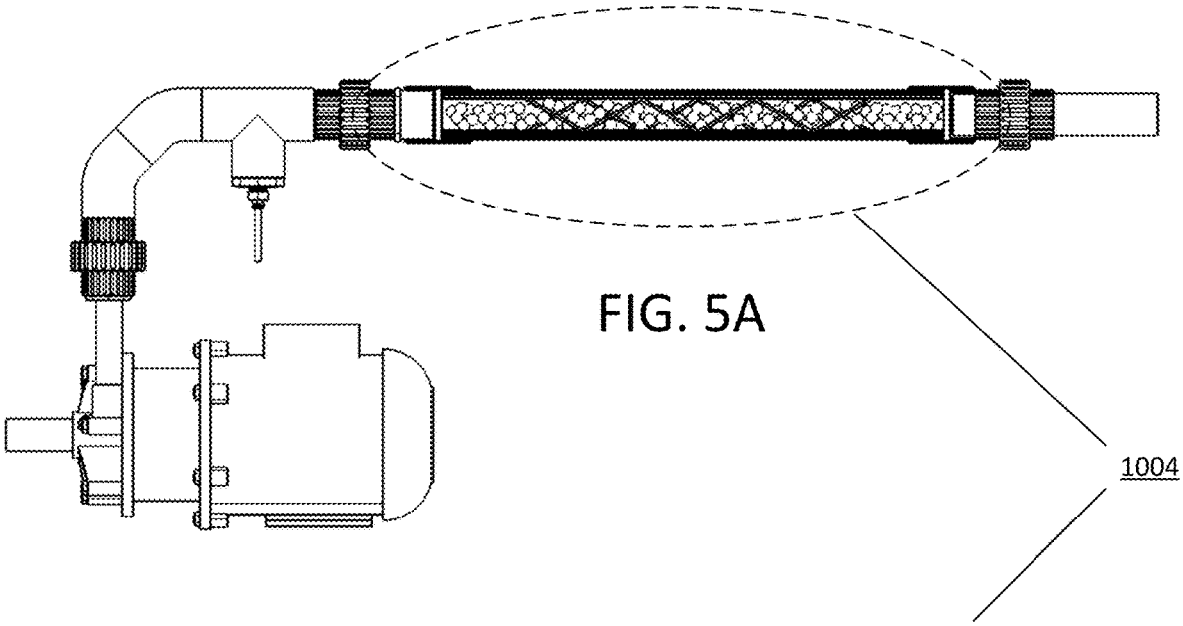
FIGS. 5A (combined view of vortexing system) and 5B (exploded view of vortexing chamber) shows an embodiment of a vortexing chamber having solid structural impediment objects interspersed among baffles.
Figure 5B:
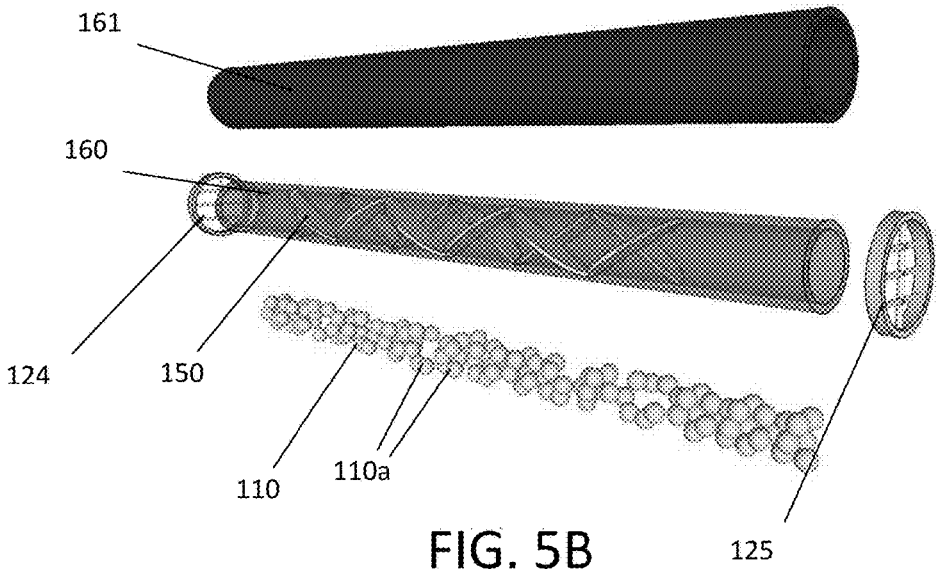

Referring now to FIGS. 5A and 5B, an embodiment of the vortexing chamber 1004 may have one or more baffles 150 housed within the hollow channel 121 of the chamber housing 120, the baffles having the same structure as shown in FIG. 4 and as described above. Furthermore, impediment objects 110 may be configured from a plurality of spherical rose quartz crystals 111 having suitable diameters. The spherical rose quartz crystals can have a diameter, for example, of ten mm to twenty-five mm, or preferably fifteen mm to nineteen mm. The rose quartz crystals are interspersed between the plates of the baffles and interior surface of the chamber housing.

This configuration advantageously provides for the combined benefits created by the baffles 150, and the passive and random movement (for example, vibrating, colliding, shaking, rotating) from the impediment objects 110 as described above.

A vortexing chamber 1004 according to this embodiment shown in FIGS. 5A and 5B, used to mix water and oxygen ($O_2$) was found to provide a surprising and unexpected result for bathing water. Bathers described an improvement in the texture of the water and improved health and medicinal benefits from bathing in the water.

The chamber housing 120 can be made of a cylindrical pipe 160, the cylinder being made of a transparent PVC. Similarly, the chamber housing 120 can comprise of a transparent cylindrical pipe 160 housed in a sleeve 161. The chamber housing can be a suitable diameter, for example, approximately five cm in diameter.

Figure 6:
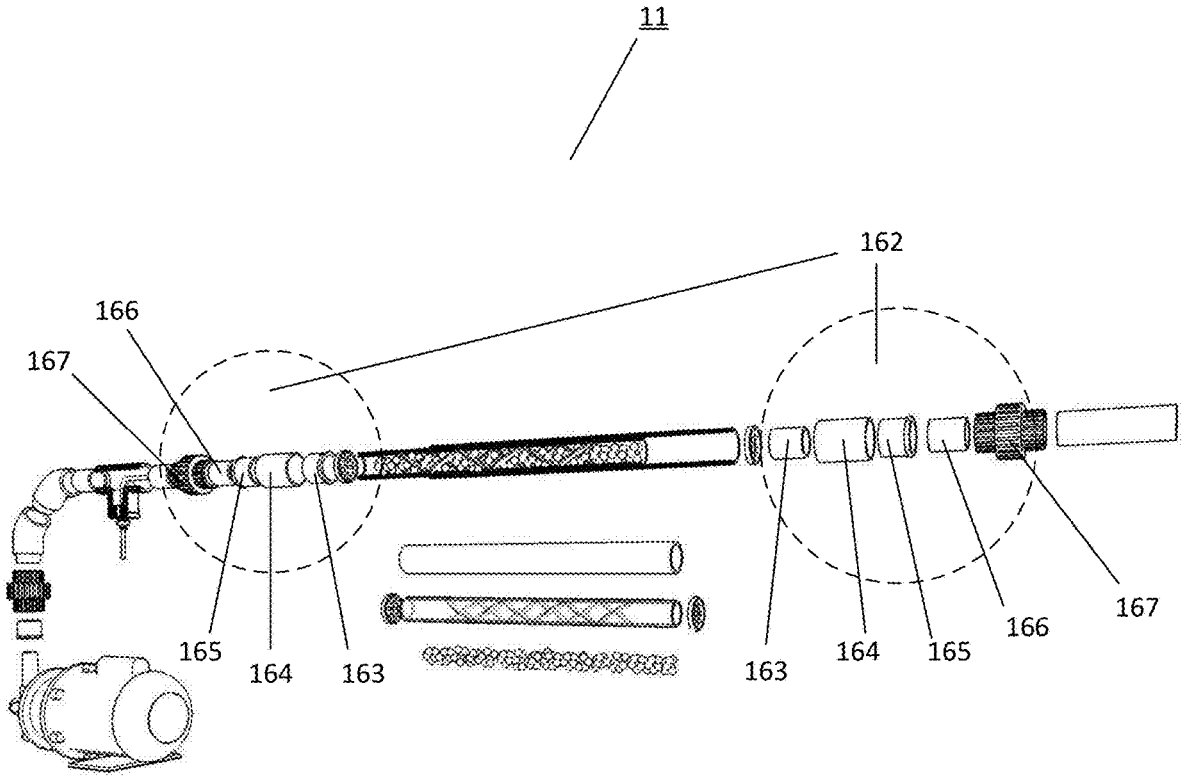
FIG. 6 (exploded view) shows an embodiment of a vortexing system having couplers and slip reducers.

Referring now to FIG. 6, a further embodiment of the vortexing system 11 may include a vortexing chamber, a pump, a gas supply, and couplers 162, located at opposite ends of the vortexing chamber. The couplers 162 can each include the ordered or unordered combination of a slip union 167, a nipple 166, a slip reducer 165, a coupler 164, and a slip reducer 163.

A number of embodiments of the disclosure have been described. Nevertheless, it will be understood that various modifications may be made without departing from the spirit and scope of the present disclosure. Accordingly, other embodiments are within the scope of the following claims.

The examples set forth above are provided to those of ordinary skill in the art as a complete disclosure and description of how to make and use the embodiments of the disclosure, and are not intended to limit the scope of what the inventor/inventors regard as their disclosure.

Modifications of the above-described modes for carrying out the methods and systems herein disclosed that are obvious to persons of skill in the art are intended to be within the scope of the following claims. All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. A vortexing chamber, comprising:

a chamber housing having a hollow channel, a first end and a second end;

one or more structural impediment objects having a substantially spherical, cubic, rectangular, cylindrical, polyhedron, tetrahedron, or irregular shape, wherein the impediment objects are housed within the chamber housing, configured to mix a liquid and gas when a liquid and gas pass through the chamber housing; and one or more internal channels housed within the hollow channel of the chamber housing, wherein:

the structural impediment objects are housed within the one or more internal channels and not in a negative space, the internal channels provide a first mixing path for the liquid and gas, and in the negative space between the internal channels and the hollow channel provides a second mixing path, the hollow channel and the one or more internal channels are substantially circular in cross section, and the one or more internal channels are in a spiral within the hollow channel.

2. The vortexing chamber according to claim 1, further comprising one or more baffles housed within the hollow channel of the chamber housing, wherein:

the baffles comprise interconnected plates joined at angles, and the impediment objects comprise of a plurality of spherical rose quartz crystals, interspersed between the plates of the baffles and interior surface of chamber housing.

3. A vortexing system, comprising:

a high velocity liquid pump;

a gas supply; and the vortexing chamber according to claim 1;

wherein:

a first end of an intermediate channel connects to an outlet of the high velocity liquid pump, a second end of the intermediate channel connects to a first end of the vortexing chamber, the gas supply is configured to introduce a gas to a liquid within the intermediate channel, an inlet of the high velocity pump connects to a liquid supply, and the high velocity liquid pump circulates a liquid through the vortexing chamber while a gas is introduced into the liquid through the gas supply, resulting in a hyper-saturated liquid-gas mixture.

4. A vortexing chamber, comprising:

a first chamber housing having a first hollow channel, a first end and a second end;

a second chamber housing having a second hollow channel, a first end, a second end;

one or more baffles housed in the second hollow channel of the second chamber housing;

wherein the first end of the second chamber housing is connected in series with the second end of the first chamber housing, and the baffles comprise interconnected plates joined at angles; and one or more structural impediment objects having a substantially spherical, cubic, rectangular, cylindrical, polyhedron, tetrahedron, or irregular shape, wherein the impediment objects are housed within the first chamber housing, configured to mix a liquid and gas when a liquid and gas pass through the first chamber housing.

5. The vortexing chamber according to claim 4, further comprising one or more internal channels housed within the first hollow channel of the first chamber housing, wherein:

the structural impediment objects are housed within the one or more internal channels and not in a negative space, the internal channels provide a first mixing path for the liquid and gas, and in the negative space between the internal channels and the first hollow channel provides a second mixing path, the first hollow channel and the one or more internal channels are substantially circular in cross section, and the one or more internal channels are in a spiral within the first hollow channel.

6. The vortexing chamber according to claim 4, further comprising one or more baffles housed within the first hollow channel of the first chamber housing, wherein:

the baffles comprise interconnected plates joined at angles, and the impediment objects comprise of a plurality of spherical rose quartz crystals, interspersed between the plates of the baffles and interior surface of the first chamber housing.

* * * * *